US008241101B2

(12) United States Patent
Nordahl et al.

(10) Patent No.: US 8,241,101 B2
(45) Date of Patent: Aug. 14, 2012

(54) SYMBOL RECOGNITION ARRANGEMENT

(75) Inventors: Mats Nordahl, Göteborg (SE); Jimmy Eiterjord, Göteborg (SE); Joakim Linde, Hisings Backa (SE)

(73) Assignee: Tangiamo AB, Gothenburg (SE)

( * ) Notice: Subject to any disclaimer, the term of this patent is extended or adjusted under 35 U.S.C. 154(b) by 477 days.

(21) Appl. No.: 12/457,027

(22) Filed: May 29, 2009

(65) Prior Publication Data

US 2010/0304838 A1 Dec. 2, 2010

(51) Int. Cl.
*A63F 9/24* (2006.01)

(52) U.S. Cl. ..... 463/16; 463/12; 463/13; 463/17; 463/20; 273/145 C; 273/145 CA; 273/146

(58) Field of Classification Search ..... 463/10, 463/22; 273/146, 145 A, 145 D, 145 C, 145 CA, 273/145 E, 145 R
See application file for complete search history.

(56) References Cited

U.S. PATENT DOCUMENTS

| | | | | |
|---|---|---|---|---|
| 7,361,090 | B2 * | 4/2008 | Lin | 463/22 |
| 7,976,372 | B2 * | 7/2011 | Baerlocher et al. | 463/12 |
| 8,025,561 | B2 * | 9/2011 | Reddicks et al. | 463/19 |
| 2005/0137008 | A1 | 6/2005 | Itagaki et al. | |
| 2007/0029726 | A1 | 2/2007 | Ohira | |
| 2007/0060301 | A1 | 3/2007 | Lin | |
| 2007/0157856 | A1 | 7/2007 | Skoog et al. | |
| 2008/0248864 | A1 * | 10/2008 | Toyoda | 463/22 |
| 2009/0224475 | A1 * | 9/2009 | Hsu et al. | 273/146 |
| 2009/0264186 | A1 * | 10/2009 | Lai et al. | 463/22 |

FOREIGN PATENT DOCUMENTS

| | | |
|---|---|---|
| WO | WO 2006/078219 | 7/2006 |
| WO | WO 2007/139484 | 12/2007 |

OTHER PUBLICATIONS

International Search Report and Written Opinion dated Sep. 10, 2010 issued in corresponding International Application No. PCT/SE2010/050571.

* cited by examiner

*Primary Examiner* — Julio J Maldonado
(74) *Attorney, Agent, or Firm* — Harness, Dickey & Pierce, P.L.C.

(57) ABSTRACT

The present invention relates to a symbol recognition arrangement for recognizing a symbol of a gambling device, comprising an image capturing device, and a control unit connected to the image capturing device. The control unit may be configured for arranging the image capturing device in a non-capture mode, acquiring a signal from an external gaming control system, evaluating the acquired signal, arranging the image capturing device in a capture mode if successfully evaluating the acquired signal and subsequently capturing an image of the gambling device, recognizing a symbol of the gambling device, and providing a result relating to the recognized symbol to a user.
Advantages with the invention include for example increased security in relation to manual operation of a dice game.

16 Claims, 3 Drawing Sheets

SYMBOL RECOGNITION ARRANGEMENT

FIELD OF THE INVENTION

The present invention relates to a symbol recognition arrangement, specifically to an arrangement adapted to recognize a symbol of a gambling device, such as a die.

DESCRIPTION OF THE RELATED ART

Traditional games involving the use of one or a plurality of dice are well known. Also in the gambling environment, such as in a casino where games may be played for money, a multitude of different games are available in which different types of dice or similar gambling devices are used. Generally, one or a plurality of dice are rolled or shaken, and players are, under the supervision of one or more dealers, allowed to wager money on the outcome against each other or the bank.

In order to improve such a game, and possibly removing the need for a dealer(s), various dice game machines have been proposed in which the outcome of the throw of the dice is automatically determined by means of a camera and a control unit adapted to perform an image recognition algorithm on the images captured by the camera for recognizing the upward facing symbols of the die. An example of such a dice game machine is disclosed in U.S. Pat. No. 7,361,090, for example describing a method including the steps of shaking multiple dice by a dice-shaking device in an opaque cap, recognizing pips on the dice with a detecting device, predicting numbers and placing stakes by players through player-interfaces, calculating scores of the players by a central control device, revealing the pips on the dice to the players by removing the opaque cap and showing the scores of the players on displays of the separate player-interfaces.

The method according to U.S. Pat. No. 7,361,090 is specifically suitable for fully automating the well known dice game "Sic Bo" (also sometimes referred to as "Cussec", "Tai Sai", "Dai Siu", "Big and Small" or "Hi-Lo"), and thereby possibly increasing the security of the gaming environment for both the casino and the players of the game. For example, as generally no dealer(s) are present, no possible error may be introduced due to a human mistake.

However, in many cases it may be desirable to also increase the level of security in relation to an already existing game setting operated by a dealer or where it is not desirable to introduce a fully automated gambling device. Accordingly, it may for example be desirable to provide means for decreasing the human error rate present in manual operation of a game making use of one or a plurality of gambling devices, such as dice.

SUMMARY OF THE INVENTION

According to an aspect of the invention, the above is at least partly met by a symbol recognition arrangement for recognizing a symbol of a gambling device, comprising an image capturing device, and a control unit connected to the image capturing device. The control unit may be configured for arranging the image capturing device in a non-capture mode, acquiring a signal from an external gaming control system, evaluating the acquired signal, arranging the image capturing device in a capture mode if successfully evaluating the acquired signal and subsequently capturing an image of the gambling device, recognizing a symbol of the gambling device, and providing a result relating to the recognized symbol for presentation to a user.

The general concept of the present invention is based on the fact that it may be possible to increase the security and minimize the presence of possible errors introduced due to a human mistake or purposeful misreading in relation to for example the recognition of a symbol of a gambling device, such as a die, by introducing an image capturing device, such as at least one of a CMOS and a CCD camera, and a specifically configured control unit that only activates, i.e. arranges the image capturing device in a capture mode after the successful acquisition and evaluation of a signal from an external gaming control system.

Accordingly, not only does the symbol recognition arrangement according to the invention provide for automated recognition of the symbols of a gambling device in a "manual" gaming setting, e.g. operated by one or a plurality of dealers, but it allows also for the possibility to hinder images to be captured by the image capturing device before at least an intermediate process step in for example a dice game is completed. As an example, the signal from the external gaming control system may be a "No more bets" signal indicated by the dealer, and the capturing of an image of gambling device may only be carried out after the signal is generated. As a consequence, the possible condition that a dealer indicates the results (e.g. the upward facing symbols of the gambling device) to a player before the "No more bets" signal is generated is eliminated, and players and/or other interested parties are hindered from gaining access to the results before the "No more bets" signal is provided.

Further advantages with the invention includes the possibility to eliminate certain types of fraud committed by players, casino staff, or players and staff in collusion, by automating the detection of the result in such a game. Also, it may be possible to reduce the amount of resources casinos need to allocate to supervision in dealer controlled games of this kind. Additionally, in situations where the game result needs to be entered into an information processing system for storage or display purposes, it may be possible to increase game speed by automating this procedure instead of the dealer performing it manually.

In a preferred embodiment the control unit may be wirelessly connected to the image capturing device, and the connection between the control unit and the image capturing device may be encrypted. Accordingly, further flexibility and security may be provided. However, it should be noted that the connection between the control unit and the image capturing device also may be wired. The selection of wired and/or wireless communication may for example depend on the gaming environment.

Furthermore, the result provided by the control unit may be configured to be displayed on a display connected to the control unit, and the connection between the display and the control unit may also be encrypted. The display may for example be provided for instant indication to the player(s) the results of the game following the "No more bets" signal.

Preferably, the evaluation of the acquired signal may comprise comparing an identifiable portion of the signal with a predetermined identity stored with the control unit. As an example, the control unit or an intermediate storage unit, such as a memory, may be pre-configured to include an identity that correspond to a specific external gaming control system, thereby providing additional security. Accordingly, the symbol recognition arrangement according to the invention may be configured to only activate the image capturing device if the correct external gaming control system provides a correct signal. However, the evaluation may also simply comprise detecting the presence of a signal from an external gaming control system.

In an embodiment the external gaming control system is a dice-shaking device. Accordingly, subsequent a predetermined time interval preceding the shaking of one or a plurality of dice by means of the die-shaking device, the die-shaking device may automatically provide an activation signal to the symbol recognition arrangement. However, and as indicated above, the external gaming control system may also (or instead) be operated by one or a plurality of dealers and accordingly not directly integrated with the die-shaking device.

Furthermore, the symbol recognition arrangement may comprise means, such as a light source, for external indication of capture mode of the image capturing device. Such an indication provides the player(s), dealer(s) and possibly one or a plurality of security cameras arranged in for example a casino environment to be notified of a change in mode from non-capture mode to capture mode.

Additionally, the symbol recognition arrangement may comprise a dome shaped structure configured to be removably fitted to a dice-shaking device, with the image capturing device arranged to face the inside of the dome shaped structure. The dome shaped structure may also comprise an electrical carrier configured to connect the control unit to the image capturing device, and the dice-shaking device may comprise corresponding intermediate connection means configured to provide an electrical path between the dome shaped structure and the control unit. As an example, the intermediate connection means may comprise a plurality of metal traces and the electrical carrier comprises corresponding metal traces configured for alignment thereto. A further more detailed description in relation to the physical implementation of the symbol recognition arrangement is provided below in relation to the detailed description of the invention.

Possibly, the control unit may be further configured for detecting the removal of the dome shaped structure from the dice-shaking device. Accordingly, it may be possible to indicate to the players and/or a supervisor (e.g. the casino) that the dome shaped structure was incorrectly removed and as a result make the current game round invalid.

In a preferred embodiment the symbol recognition arrangement may form a part of a gaming system further comprising a dice-shaking device and a gaming control system. Additionally, the gaming system may comprise a multi-user gaming interface for allowing a plurality of players to engage into for example a die game supported by the symbol recognition arrangement. The multi-user gaming interface may for example comprise a common touch sensitive surface for a plurality of users, in an embodiment comprising means for individual identification of the plurality of users.

The symbol recognition arrangement according to the invention may be provided as a part in a plurality of different game settings, for example game settings configured according to at least one of Sic Bo/Cussec/Tai Sai/Dai Siu/Big and Small/Hi-Lo, Fish-Prawn-Crab/Hoo Hey How, Grand Hazard/Chuck-a-Luck/Birdcage, and/or in relation to different possible side bets to other games, e.g. Double-Bet Roulette (e.g. additional betting options that for example create bets with higher odds than in ordinary roulette).

Further features of, and advantages with, the present invention will become apparent when studying the appended claims and the following description. The skilled addressee realizes that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION OF CURRENTLY PREFERRED EMBODIMENTS

Figure 1:
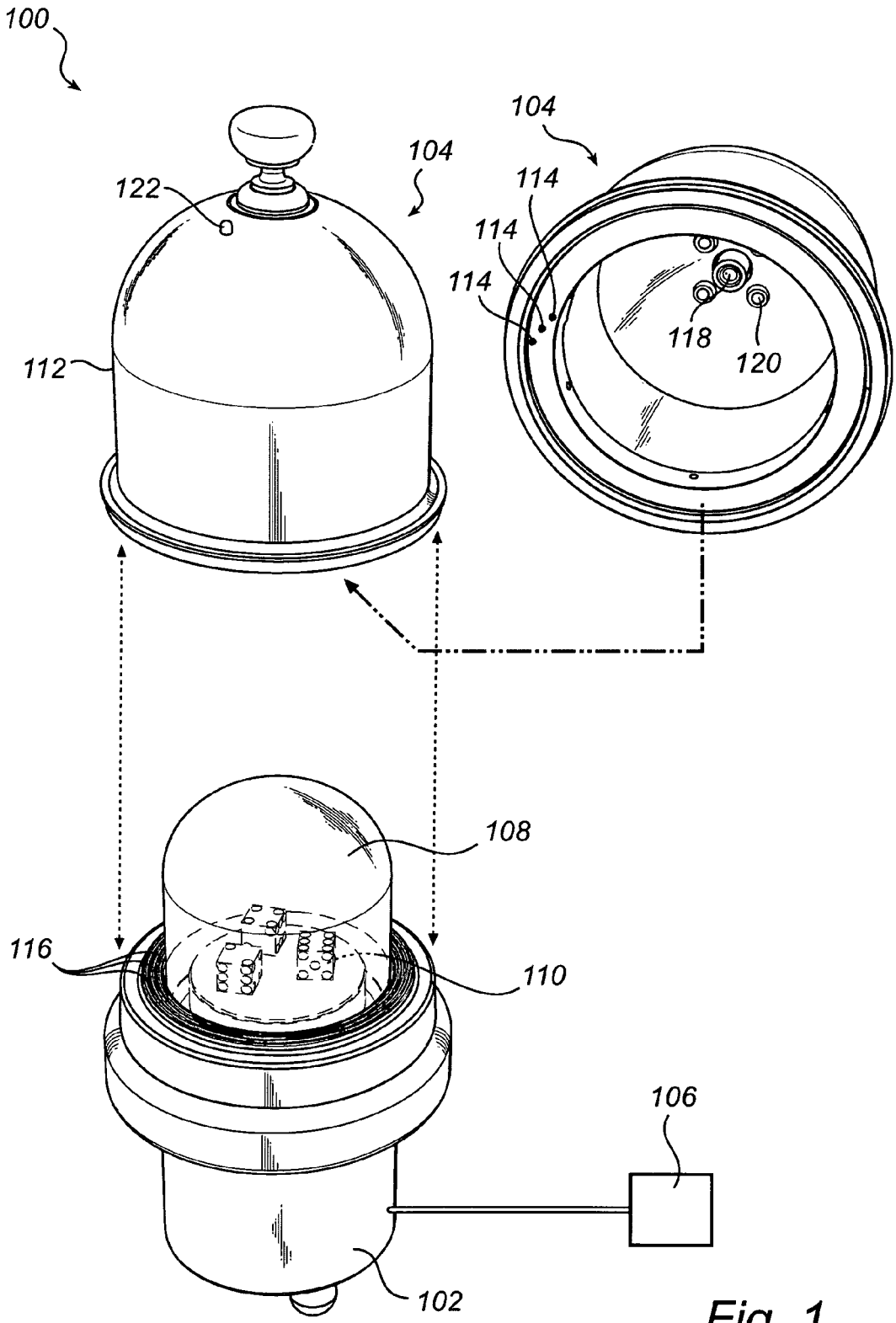
FIG. 1 illustrates a gaming system comprising a dice-shaking device and an exemplary symbol recognition arrangement.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a gaming system 100 comprising a dice-shaking device 102, a symbol recognition arrangement 104 according to a currently preferred embodiment of the invention and an external gaming control system 106 for controlling the gaming system 100.

In the illustrated embodiment the dice-shaking device 102 comprises a transparent cover 108 covering a plurality of dice 110, internally arranged means in the dice-shaking device 102 for shaking the dice 110. The means for shaking the dice 110 may for example include a mechanically wobbling surface that in turn shakes the dice 110. The time of shaking of the dice 110 may for example be controlled by means of the gaming control system 106 and being operated by one or a plurality of dealers.

The symbol recognition arrangement 104 comprises an opaque dome shaped structure 112 configured to be removably fitted to a die-shaking device 102. The symbol recognition arrangement 104 further comprises a plurality of metal pins 114 for providing a power and communication path between the symbol recognition arrangement 104 and the die-shaking device 102. Correspondingly, the dice-shaking device 102 comprises metal traces 116 to be connected to the metal pins 114 when fitting the dome shaped structure 112 of the symbol recognition arrangement 104 to the dice-shaking device 102.

The symbol recognition arrangement 104 further comprises an image capturing device 118 and a control unit (not shown) configured to be in connection with the image capturing device 118. The image capturing device 118 may be a camera, for example comprising a CCD or a CMOS sensor. Additionally, for providing illumination that may be used by the image capturing device 118 in capturing an image, the symbol recognition arrangement 104 may be provided with one or a plurality of light sources 120, such as a plurality of LEDs. The LEDs may emit light within a visible wavelength, but may also, or instead, emit light within with an infrared wavelength. Accordingly, the image capturing device 118 may be provided with a filter for only allowing light within a specific, corresponding, wavelength range to be allowed to reach the capturing means of the image capturing device 118. Furthermore, the symbol recognition arrangement 104 may comprise an indicative light source 122 for indicating a capturing mode for the image capturing device 118.

Furthermore, the control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. The positioning of the control unit may depend on the specific application, and may in one embodiment be comprised adjacent to the image capturing device 118, and in another embodiment be positioned adjacently to the external gambling control system 106.

The connection between the image capturing device 118 and the control unit may be wireless, including for example an RF related transmission protocol, that may be encrypted. However, the connection between the image capturing device 118 and the control unit may also, or instead, be wired such as is provided by means of the metal pins 114 and metal traces 116. Also the wired communication between the image capturing device 118 and the control unit may be encrypted.

In an embodiment the control unit may be configured to detect the removal of the dome shaped structure 112 from the dice-shaking device 102 prior to a predetermined valid removal of the dome shaped structure 112. Accordingly, it may be possible to indicate to the players and/or a supervisor (e.g. the casino) that the dome shaped structure 112 was incorrectly removed and as a result make the current game round invalid. For achieving such functionality it may be possible to provide a constant transmission of information using the pins 114 and the metal traces 116. It may also be possible to provide a switch that is activated at the time of removal of the dome shaped structure 112.

Figure 2:
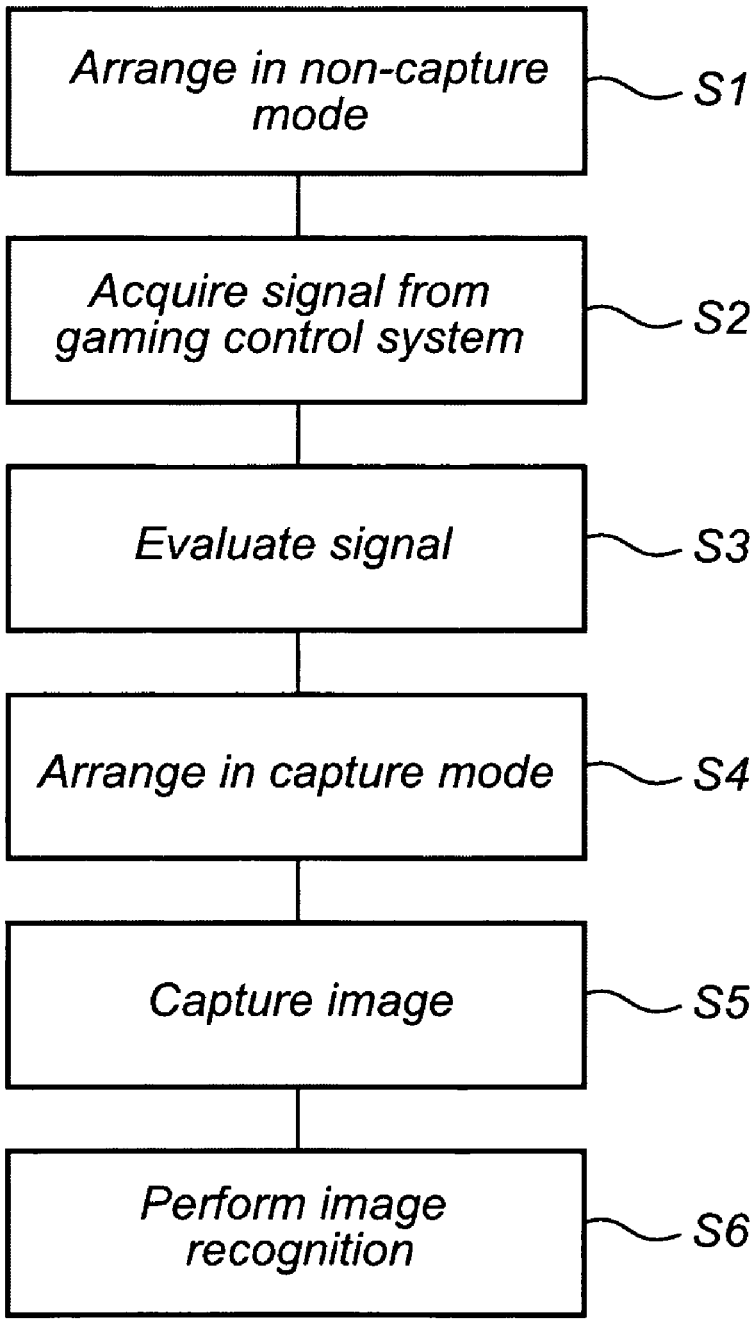
FIG. 2 is a flow chart illustrating exemplary processing steps performed by a control unit comprised with the symbol recognition arrangement.
Figure 3:
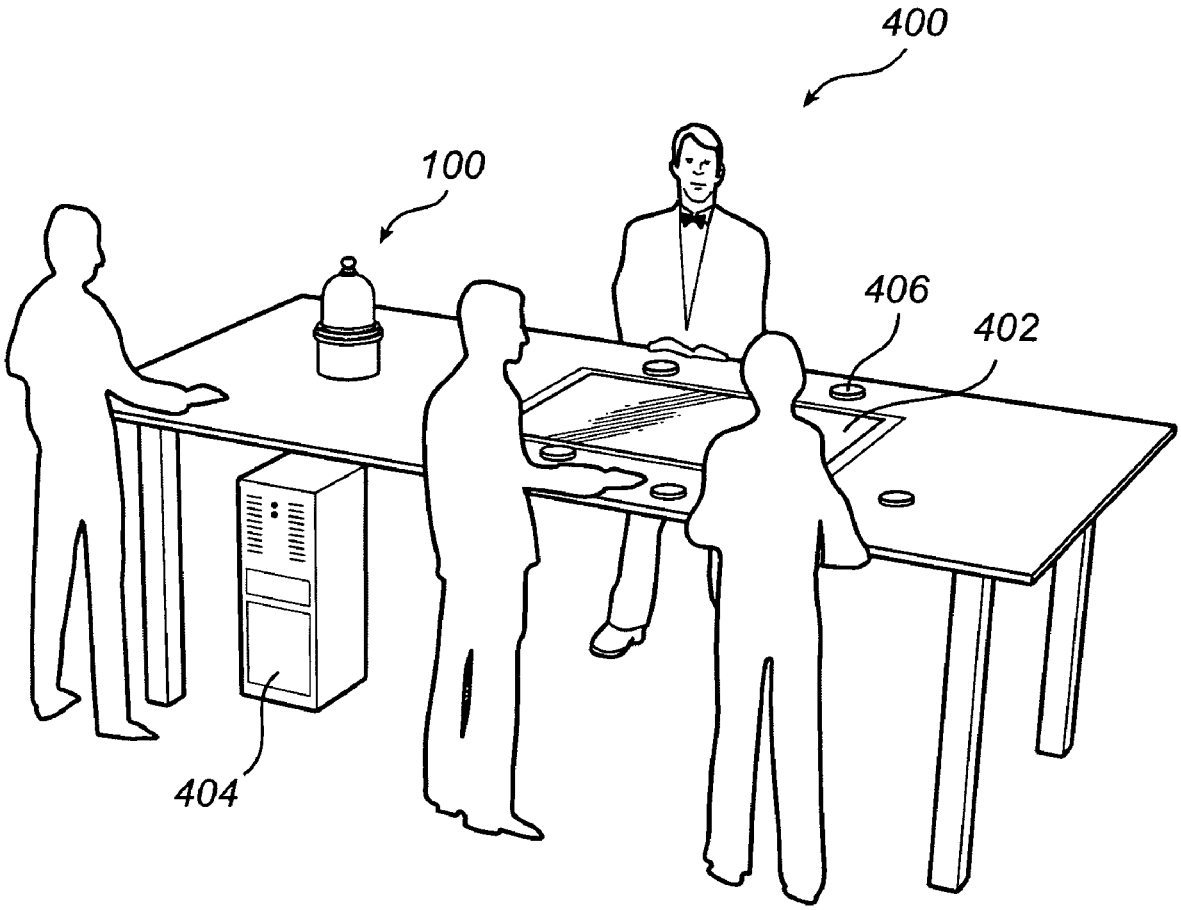
FIG. 3 illustrates a gaming system further comprising a multi-user gaming interface.

Turning now to FIG. 2, which illustrate a flow chart showing exemplary processing steps performed by the control unit comprised with the symbol recognition arrangement 104. That is, during operation of the symbol recognition arrangement 104, the control unit may be configured to perform a number of specific steps.

The steps include a first step S1 in which the image capturing device 118 is arranged in a non-capture mode. The non-capture mode may be a state in which a shutter is arranged in front of the image capturing device 118, or a state where the image capturing device simply is turned off such that it may not capture any images.

In step S2 a signal is acquired from the external gaming control system 106 representing for example the intermediate break in a die game where a dealer is indication for the player(s) that no more bets are allowed. The signal from the gaming control system 106 may thus be dealer initiated but may also or instead be generated automatically depending on a specific time from the start of shaking of the dice by means of the die-shaking device 102. That is, the game may be arrange to be semi-automated, where a dealer handles all the bets but where the dealer is supported by a predetermined time limit.

In step S3 the acquired signal is evaluated by the control unit, and it is determined if the signal is a valid signal. Accordingly, it is possible to configure the signal such that it is identifiably coded such that the control unit may compare the coded signal with a predetermined (and pre-stored) code sequence for determining the validity of the signal. As a result, it may be possible to hinder unauthorized access to the image capturing device 118.

Following a valid signal, the image capturing device 118 is arranged in a capture mode, step S4, where one or pluralities of images are captured, step S5, possibly also activating the LEDs 120 to achieve capturing of one or pluralities of images of suitable quality.

The image(s) is in a following step S6 provided to an image recognition algorithm configured to recognize a symbol of the die inside of the transparent cover 108. The image recognition algorithm may be specifically configured for different types of dice, e.g. gambling devices having different faces, including the pips of a normal cubical die. The image recognition algorithm may also be targeted to recognize different symbols of different gambling devices, such as non-cubical dice having more than six sides, and dice having symbols differing from the pips of normal dice.

If the symbols of one or a plurality of dice are successfully recognized, the result are provide to one or a plurality of players, step S7, possibly being displayed on a display connected to the control unit. The communication between the control unit and the display may possibly be wireless and/or encrypted.

Turning finally to FIG. 4 which illustrates a gaming system 400 further from the gaming system 100 of FIG. 1, also comprising a multi-touch user interface 402 for one of a plurality of players. The multi-touch user interface 402 preferably comprises a common touch sensitive surface possibly arranged on top of the display for displaying the results provide by the symbol recognition system 100. The display may for example be a dynamically configurable display, such as an LCD panel, connected to a computer 404 for handling bets provided by the players. For allowing the different players to place bets, the multi-touch user interface 402 may comprise identification means 406 for differentiate the different users from each other. Such identification means 406 may comprise a multitude of sensors, and the results captured by the sensor may in turn be correlated for determining the identity of the user.

In summary, the present invention relates to a symbol recognition arrangement for recognizing a symbol of a gambling device, comprising an image capturing device, and a control unit connected to the image capturing device. The control unit may be configured for arranging the image capturing device in a non-capture mode, acquiring a signal from an external gaming control system, evaluating the acquired signal, arranging the image capturing device in a capture mode if successfully evaluating the acquired signal and subsequently capturing an image of the gambling device, recognizing a symbol of the gambling device, and providing a result relating to the recognized symbol to a user.

Advantages with the invention include for example increased security in relation to manual operation of a die game. For example, it may according to the invention be possible to eliminate certain types of fraud committed by players, casino staff, or players and staff in collusion, by automating the detection of the result in such a game. Also, it may be possible to reduce the amount of resources casinos need to allocate to supervision in dealer controlled games of this kind. Additionally, in situations where the game result needs to be entered into an information processing system for storage or display purposes, it may be possible to increase game speed by automating this procedure instead of the dealer performing it manually.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A symbol recognition arrangement for recognizing a symbol of a gambling device, comprising:

an image capturing device;

a control unit connected to the image capturing device for:

arranging the image capturing device in a non-capture mode, acquiring a signal from an external gaming control system, evaluating the acquired signal, arranging the image capturing device in a capture mode if successfully evaluating the acquired signal and subsequently capturing an image of the gambling device, recognizing a symbol of the gambling device, and providing a result relating to the recognized symbol for presentation to a user; and a dome shaped structure configured to be removably fitted to a dice-shaking device, wherein the control unit is further configured for detecting the removal of the dome shaped structure from the dice-shaking device.

2. Symbol recognition arrangement according to claim 1, wherein the image capturing device is at least one of a CMOS and a CCD camera.

3. Symbol recognition arrangement according to claim 1, wherein the control unit is wirelessly connected to the image capturing device.

4. Symbol recognition arrangement according to claim 1, wherein the connection between the control unit and the image capturing device is encrypted.

5. Symbol recognition arrangement according to claim 1, wherein the result is displayed on a display connected to the control unit, and the connection between the display and the control unit is encrypted.

6. Symbol recognition arrangement according to claim 1, wherein evaluating the acquired signal comprises comparing an identifiable portion of the signal with a predetermined identity stored with the control unit.

7. Symbol recognition arrangement according to claim 1, wherein the external gaming control system is a dice-shaking device.

8. Symbol recognition arrangement according to claim 1, further comprising means for external indication of capture mode of the image capturing device.

9. Symbol recognition arrangement according to claim 8, wherein the means for external indication comprises a light source.

10. Symbol recognition arrangement according to claim 1, wherein the dome shaped structure comprises an electrical carrier configured to connect the control unit to the image capturing device, and the dice-shaking device comprises intermediate connection means configured to provide an electrical path between the dome shaped structure and the control unit.

11. Symbol recognition arrangement according to claim 10, wherein the intermediate connection means comprises a plurality of metal traces and the electrical carrier comprises corresponding metal traces configured for alignment thereto.

12. Gaming system, comprising:

a symbol recognition arrangement according to claim 1, a dice-shaking device; and a gaming control system.

13. Gaming system according to claim 12, further comprising a multi-user gaming interface.

14. Gaming system according to claim 13, wherein the multi-user gaming interface comprises a common touch sensitive surface for a plurality of users.

15. Gaming system according to claim 14, wherein the multi-user gaming interface further comprises means for individual identification of the plurality of users.

16. A symbol recognition arrangement for recognizing a symbol of a gambling device, comprising:

an image capturing device;

a control unit connected to the image capturing device for:

arranging the image capturing device in a non-capture mode, acquiring a signal from an external gaming control system, evaluating the acquired signal, arranging the image capturing device in a capture mode if successfully evaluating the acquired signal and subsequently capturing an image of the gambling device, recognizing a symbol of the gambling device, and providing a result relating to the recognized symbol for presentation to a user; and a dome shaped structure configured to be removably fitted to a dice-shaking device, where the image capturing device is arranged to face the inside of the dome shaped structure, wherein the control unit is further configured for detecting the removal of the dome shaped structure from the dice-shaking device.

* * * * *